US006700323B2

(12) United States Patent
Amemiya

(10) Patent No.: US 6,700,323 B2
(45) Date of Patent: Mar. 2, 2004

(54) PLASMA DISPLAY PANEL

(75) Inventor: Kimio Amemiya, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 70 days.

(21) Appl. No.: 10/146,903

(22) Filed: May 17, 2002

(65) Prior Publication Data

US 2003/0001501 A1 Jan. 2, 2003

(30) Foreign Application Priority Data

Jun. 29, 2001 (JP) ..... 2001-198426

(51) Int. Cl.[7] ..... H01J 17/49

(52) U.S. Cl. ..... 313/582; 313/584

(58) Field of Search ..... 313/582, 584, 313/585, 586

*Primary Examiner*—Vip Patel

(74) *Attorney, Agent, or Firm*—Arent Fox Kintner Plotkin & Kahn

(57) ABSTRACT

A plasma display panel comprises a plurality of row electrode pairs (X, Y) provided on a front glass substrate 10, a plurality of column electrodes D provided on a back glass substrate 13 and each intersecting the row electrode pairs, and discharge cells C which are defined in a discharge space S to correspond to the respective intersections. The row electrode Y of each row electrode pair (X, Y) has transparent electrodes Ya each constructed by a leading member Ya1 and a base member Ya2. The column electrode D is provided with enlargement members Da, having a width in a row direction larger than that of the base member Ya2, in a position opposite to the leading member Ya1.

9 Claims, 9 Drawing Sheets

SECTION V1-V1

SECTION V2-V2

SECTION W1-W1

SECTION W2-W2

RRIOR ART

SECTION V-V

RRIOR ART

SECTION W-W

PLASMA DISPLAY PANEL

BACKGROUND OF THE INVENTION

1. Field of the Invention

This invention relates to a surface discharge-scheme alternating current-type plasma display panel and, more particularly, to a panel structure for causing a selective discharge in an addressing period.

The present application claims priority from Japanese Application No. 2001-198426, the disclosure of which is incorporated herein by reference for all purposes.

2. Description of the Related Art

In recent time, a surface discharge-scheme alternating current-type plasma display panel which has been developed as a slim, large sized color screen display has become commonly used in ordinary household.

FIG. 10 is a schematic plan view of a conventional cell structure of the surface discharge-scheme alternating current-type plasma display panel. FIG. 11 is a sectional view taken along the V—V line of FIG. 10. FIG. 12 is a sectional view taken along the W—W line of FIG. 10.

In FIGS. 10 to 12, the plasma display panel (hereinafter referred to as "PDP") includes a front glass substrate 1, serving as the display surface of the PDP, having on its back surface, in order, a plurality of row electrode pairs (X', Y'), a dielectric layer 2 covering the row electrode pairs (X', Y'), and a protective layer 3 made of MgO and covering the back surfaces of the dielectric layer 2.

The row electrode X' and the row electrode Y' of each row electrode pair (X', Y') are respectively constructed of transparent electrodes Xa', Ya' each of which is formed of a transparent conductive film of a larger width made of ITO (Indium Tin Oxide) or the like, and bus electrodes Xb", Yb' each of which is formed of a metal film of a smaller width compensating for electrical conductivity of the corresponding transparent electrode.

The row electrodes X' and Y' are arranged in alternate positions in the column direction so that the electrodes X' and Y' of each pair (X', Y') face each other with a discharge gap g' between. Each of the row electrode pairs (X', Y') forms each display line (row) L in the matrix display.

The front glass substrate 1 is situated opposite a back glass substrate 4. A discharge space S' filled with a discharge gas is interposed between the substrates 1 and 4. The back glass substrate 4 is provided with a plurality of column electrodes D' which are arranged parallel to each other and each extend in a direction at right angles to the row electrode pair (X, Y) (the column direction), band-shaped partition walls 5 each extending in parallel to and between the two column electrodes D', and phosphor layers 6 provided for emitting the primary colors red (R), green (G), and blue (B), each of which covers the side faces of adjacent partition walls 5 and the column electrode D'.

In each display line L, the partition walls 5 partition the discharge space S' into areas each corresponding to an intersection of the column electrode D' and the row electrode pair (X', Y'), to define discharge cells (unit light emitting areas) C'.

Such surface discharge-scheme alternative current PDP displays images through the following procedure.

First, in the addressing period, an operation pulse is applied to any one (assumed as the row electrode Y' in this case) of the row electrode pair (X', Y'), and a data pulse is applied to the column electrode D', to selectively cause discharge between the row electrode Y' and the column electrode D'.

As a result, lighted cells (the discharge cell C' in which the wall charge is formed on the dielectric layer 2) and non-lighted cells (the discharge cell C' in which the wall charge is not formed on the dielectric layer 2) are distributed over the panel surface in accordance with an image subject to be displayed.

After completion of the addressing period, a discharge sustaining pulse is simultaneously applied alternately to the row electrode pair (X', Y') in all the display lines. In each application of the discharge sustaining pulse, a surface discharge (sustaining discharge) is caused in each lighted cell.

In this way, the surface discharge generates ultraviolet light in the lighted cells. The generated ultraviolet light excites the phosphor layer 6 in each lighted cell to thereby emit light of the three primary colors red (R), green (G) and blue (B) for forming a display image.

However, such a conventional display panel has a problem of reduced yields of the lighted cells (or non-lighted cells) resulting from the selective discharge because the selective discharge in the addressing period is caused in the discharge cell C' over an entire face of a part, overlaying the column electrode D' when viewed from the front glass substrate 1, of one of the row electrode pair (the row electrode Y' assumed in this case). Hence, a discharge area is disadvantageously increased to make the selective discharge unstable.

SUMMARY OF THE INVENTION

The present invention has been made to solve the problem associated with the surface discharge-scheme alternating current-type plasma display panel as described above.

Accordingly, it is an object of the present invention to provide a plasma display panel capable of producing stable selective discharge to generate high quality images.

To attain the above object, according to a first feature of the present invention, a plasma display panel includes: a front substrate; a back substrate placed opposite to the front substrate to define a discharge space between the front and back substrates; a plurality of row electrode pairs extending in a row direction and arranged in a column direction on a back surface of the front substrate to respectively form display lines; and a plurality of column electrodes arranged in the row direction on a surface, facing toward the front substrate, of the back substrate, and extending in the column direction to intersect the row electrode pairs and form unit light emitting areas in the discharge space at the respective intersections, which comprises: a leading member provided in each paired row electrodes of the row electrode pairs and facing each other with a discharge gap there-between in each unit light emitting area; and an enlargement member provided in the column electrode at a position opposite to at least one of leading members of the paired row electrodes in each unit light emitting area, and having a width in the row direction larger than a width of portion of the column electrode opposite to the row electrode except for the leading member opposite to the enlargement member.

In the plasma display panel according to the first feature, in an addressing period when an image is generated on a panel screen on the basis of an image signal, an operation pulse is applied to one row electrode of each row electrode pair and a data pulse is applied to the column electrode. Then, in each unit light emitting area in which the row electrode applied with the operation pulse intersects the column electrode applied with the data pulse, a selective discharge is caused between the row electrode and the column electrode. As a result, lighted cells and non-lighted cells are distributed over the panel surface in accordance with an image to be displayed.

In this addressing period, due to the enlargement member provided in the column electrode, an opposite area of the column electrode to the leading member of the row electrode between which the selective discharge is caused, is significantly enlarged more than an opposite area of the column electrode to the row electrode except for the leading member. Accordingly, the selective discharge is caused concentratedly between the leading member of the row electrode and the enlargement member of the column electrode, which are opposite to each other.

With the first feature, it is possible to prevent the discharge property instability which results from extensively producing, over the entire surface of the row electrode, the selective discharge between the row electrode and the column electrode.

Even when, for example, a partition wall for defining the unit light emitting areas is formed between the front substrate and the back substrate, and the partition wall is overlapped with part of the row electrode undergoing the selective discharge, the discharge properties of the selective discharge can be prevented from being adversely affected by the partition wall, because the selective discharge is caused substantially in a central part of the unit light emitting area.

To attain the aforementioned object, according to a second feature of the present invention, a plasma display panel further comprises, in addition to the configuration of the first feature, a phosphor layer for emitting a different color in each unit light emitting area, in which the enlargement member of the column electrode is changed in width in the row direction to be smaller in order of the colors facilitating the discharge between the row electrode and the column electrode.

With the second feature, the discharge properties of the phosphor layers vary with the colors of phosphor materials used for forming the phosphor layers each of which is formed in each unit light emitting area and is applied with a different color from that of another phosphor layer. Therefore, the enlargement member provided in the column electrode is designed to have a small width in the row direction in the unit light emitting area which is provided with the phosphor layer applied with a color facilitating the discharge between the row and column electrodes, and to have a larger width in the unit light emitting area which is provided with the phosphor layer applied with a color resistant to cause the discharge between the row and column electrodes. With such design, the discharge properties varied among the colors of the phosphor layers are adjusted to cause a uniform selective discharge in each unit light emitting area.

To attain the aforementioned object, according to a third feature of the present invention, in addition to the configuration of the second feature, the enlargement member of the column electrode has, in the row direction, a small width of a side facing toward the unit light emitting area provided with the red phosphor layer, and a larger width of a side facing toward unit light emitting area provided with the blue phosphor layer, and a much larger width of a side facing the unit light emitting area provided with the green phosphor layer.

With the third feature, regarding the red, blue and green phosphor layers formed in the individual unit light emitting areas, phosphor materials used for forming the red phosphor layer facilitates the discharge, but phosphor materials used for forming the green phosphor layer is resistant to cause the discharge. Coping with such phosphor materials, the plasma display panel provides a smaller width for the enlargement member of the column electrode positioned in the unit light emitting area provided with the red phosphor layer, and a larger width for the enlargement member positioned in the unit light emitting area provided with the green phosphor layer. With this manner, the variations of the discharge properties according to the colors of the phosphor are adjusted to cause a uniform selective discharge in each unit light emitting area.

To attain the aforementioned object, in a plasma display panel according to a fourth feature of the present invention, in addition to the configuration of the first feature, the enlargement members are provided in pair in the column electrode at respective positions opposite to the leading members of the paired row electrodes in each unit light emitting area, and having a width in the row direction larger than a width of portion of the column electrode opposite to the row electrode except for the leading member opposite to the enlargement member.

With the fourth feature, the enlargement member provided in a portion of the column electrode opposite to the leading member of the row electrode undergoing the selective discharge, serves as a function of concentrating of the selective discharge into a substantially central part of the unit light emitting area, to prevent the discharge properties of the selective discharge from becoming unstable. In addition, when lighted cells are selected by means of the selective discharge in a selective erase scheme, and then discharge is continuously caused between one of the row electrodes paired, which has undergone the selective discharge together with the column electrode, and the other row electrode in each unit light emitting area, the plasma display panel facilitates the later discharge due to one of the enlargement members provided in pair in the column electrode which is opposite to the leading member of the other row electrode.

To attain the aforementioned object, in a plasma display panel according to a fifth feature of the present invention, in addition to the configuration of the first feature, the enlargement member is provided in the column electrode at a position opposite to both of the leading members of the paired row electrodes in each unit light emitting area, and having a width in the row direction larger than a width of portion of the column electrode opposite to the row electrode except for the leading members opposite to the enlargement members.

With the fifth feature, the enlargement member provided in the column electrode so as to be opposite to the leading member of the row electrode undergoing the selective discharge, serves as a function of concentrating of the selective discharge into a substantially central part of the unit light emitting area, to prevent the discharge properties of the selective discharge from becoming unstable. In addition, when lighted cells are selected by means of the selective discharge in a selective erase scheme, and then discharge is continuously caused between one of the row electrodes paired, which has undergone the selective discharge together with the column electrode, and the other row electrode in each unit light emitting area, the plasma display panel facilitates the later discharge due to the enlargement member provided in the column electrode which is opposite to the leading member of the other row electrode.

To attain the aforementioned object, according to a sixth feature of the present invention, in addition to the configuration of the first feature, the plasma display panel further comprises phosphor layers for emitting different colors, each provided in each unit light emitting area and having a larger thickness as the phosphor layer more facilitates the discharge between the row electrode and the column electrode.

With the sixth feature, the discharge properties of the phosphor layers vary with the colors of phosphor materials used for forming the phosphor layers each of which is formed in each unit light emitting area and is applied with a different color from that of another phosphor layer. Therefore, the phosphor layer is set for each unit light emitting area to have a larger thickness when being applied with a color facilitating the discharge between the row and column electrodes, and to have a smaller thickness when being applied with a color resistant to cause the discharge between the row and column electrodes. With such varying in thickness, the discharge properties varied among the colors of the phosphor layers are adjusted to cause a uniform selective discharge in each unit light emitting area.

To attain the aforementioned object, according to a seventh feature of the present invention, in addition to the configuration of the sixth feature, the phosphor layer is reduced in thickness in order of the unit light emitting area provided with the red phosphor layer, the unit light emitting area provided with the blue phosphor layer, and the unit light emitting area provided with the green phosphor layer.

With the seventh feature, when the red, blue and green phosphor layers are formed in the individual unit light emitting areas, phosphor materials used for forming the red phosphor layer facilitates the discharge, but phosphor materials used for forming the green phosphor layer resistant to cause the discharge. Coping with such phosphor materials, the plasma display panel is designed such that the red phosphor layer has a largest thickness and the green phosphor layer has a smallest thickness, in order to adjust the discharge properties varied with the colors of the phosphor layer, thereby achieving a uniform selective discharge caused in each unit light emitting area.

To attain the aforementioned object, in a plasma display panel according to an eighth feature of the present invention, in addition to the configuration of the first feature, the row electrodes of each of the row electrode pairs respectively include main bodies extending in the row direction, and jutting sections extending from the respective main bodies in the column direction to face each other with the discharge gap there-between in each of the unit light emitting areas, and respectively having base members connected to the respective main bodies, and the leading members facing each other and each having a width larger than that of the base member, in which the enlargement member of the column electrode is opposite to the leading member having the larger width of the jutting section of one of the paired row electrodes.

With the eighth feature, in each unit light emitting area, each of the leading members facing each other is provided with an increased width in the independent, so-called island-shaped jutting section of each row electrode. The selective discharge in the addressing period is carried out between the increased width leading member of the jutting section and the corresponding enlargement member of the column electrode. Accordingly the selective discharge is caused concentratedly in a substantially central part of each unit light emitting area, leading to a further stabilized discharge properties.

To attain the aforementioned object, according to a ninth feature of the present invention, in addition to the configuration of the first feature, a plasma display panel further comprises a partition wall between the front substrate and the back substrate, having vertical walls each extending in the column direction and transverse walls each extending in the row direction, and provided for partitioning the discharge space, defined between the front and back substrates, in the row and column directions to define the unit light emitting areas.

With the ninth feature, the discharge space defined between the front and back substrates is partitioned into quadrangles by the vertical walls extending in the column direction and transverse walls extending in the row direction of the partition wall, to define the unit light emitting areas. The selective discharge is carried out between the leading member of one row electrode of each row electrode pair and the enlargement member of the column electrode in each unit light emitting area defined by the partition wall.

These and other objects and features of the present invention will become more apparent from the following detailed description with reference to the accompanying drawings.

DETAILED DESCRIPTION OF THE PREFERRED EMBODIMENT

A preferred embodiment according to the present invention will be described hereinafter in detail with reference to the accompanying drawings.

Figure 1:
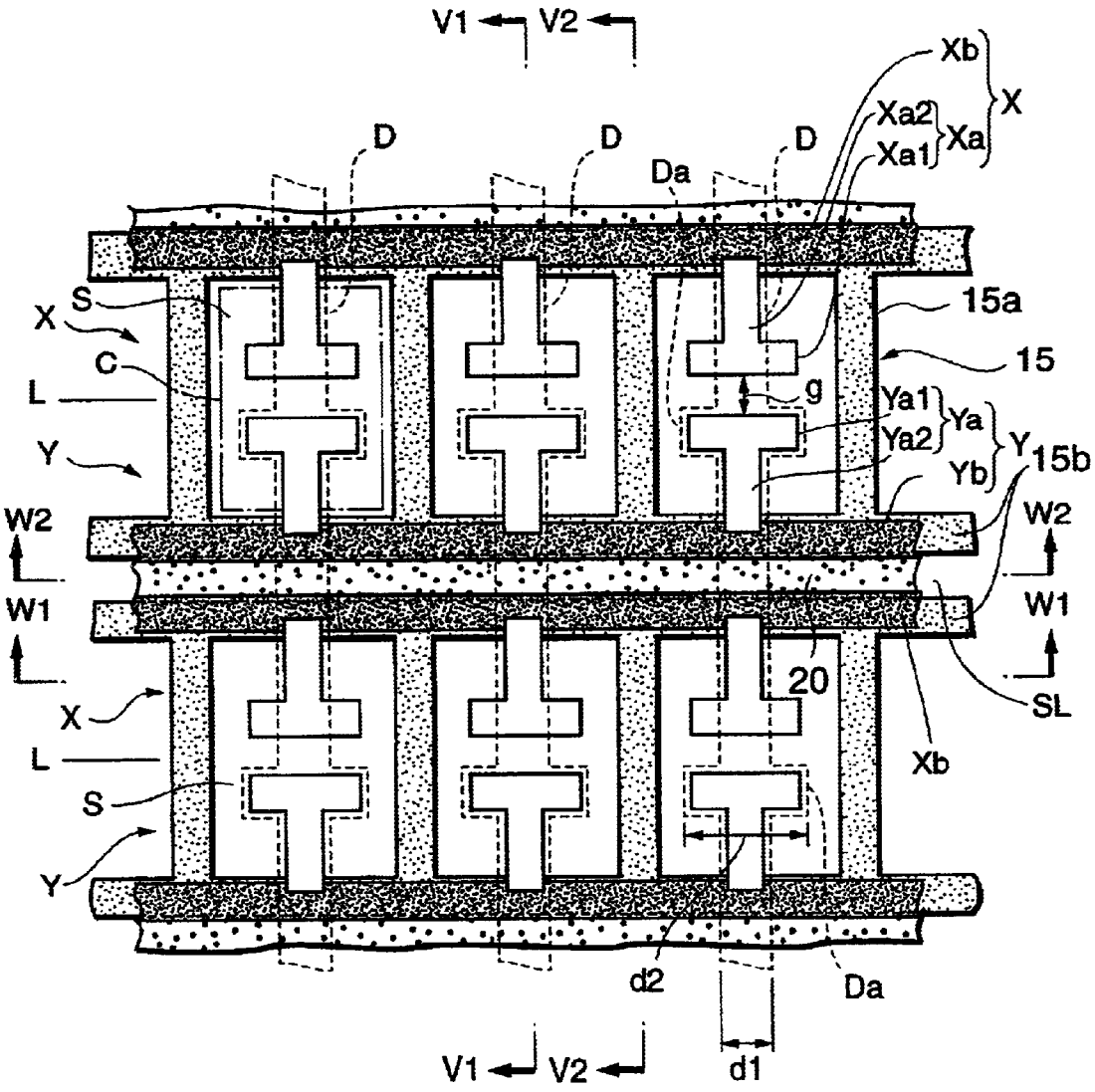
FIG. 1 is a schematic front view of a first example according to an embodiment of the present invention.
Figure 2:
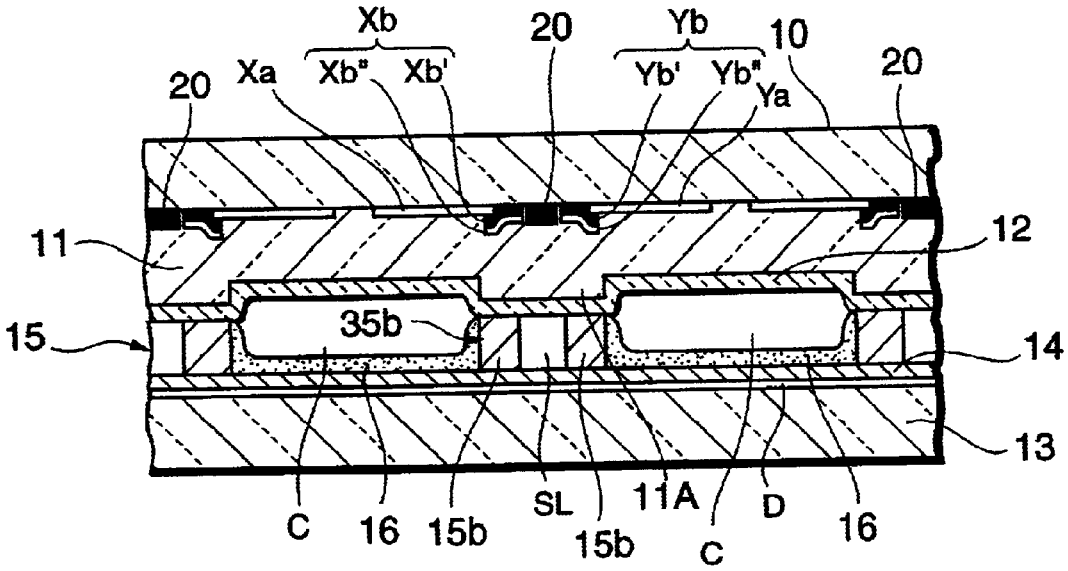
FIG. 2 is a sectional view taken along the V1—V1 line of FIG. 1.
Figure 3:
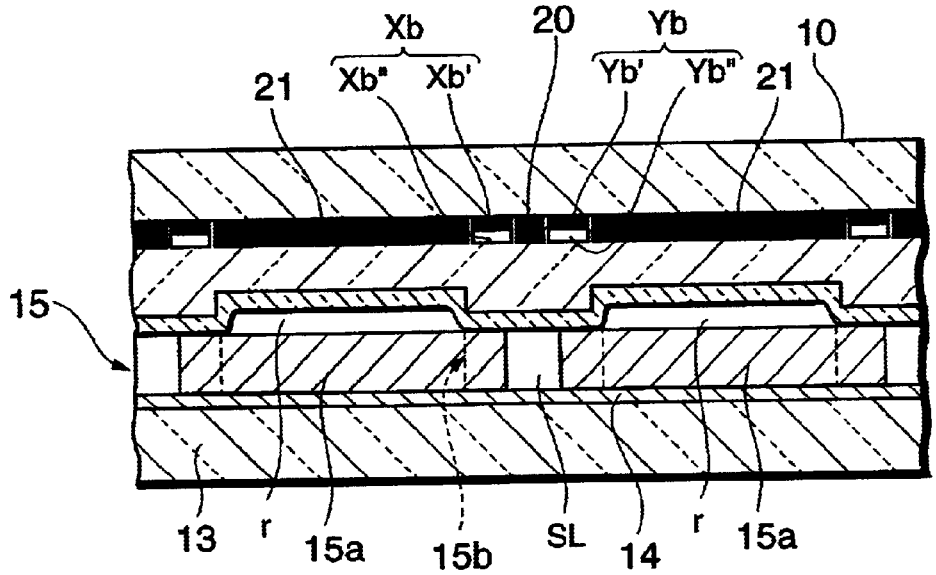
FIG. 3 is a sectional view taken along the V2—V2 line of FIG. 1.
Figure 4:
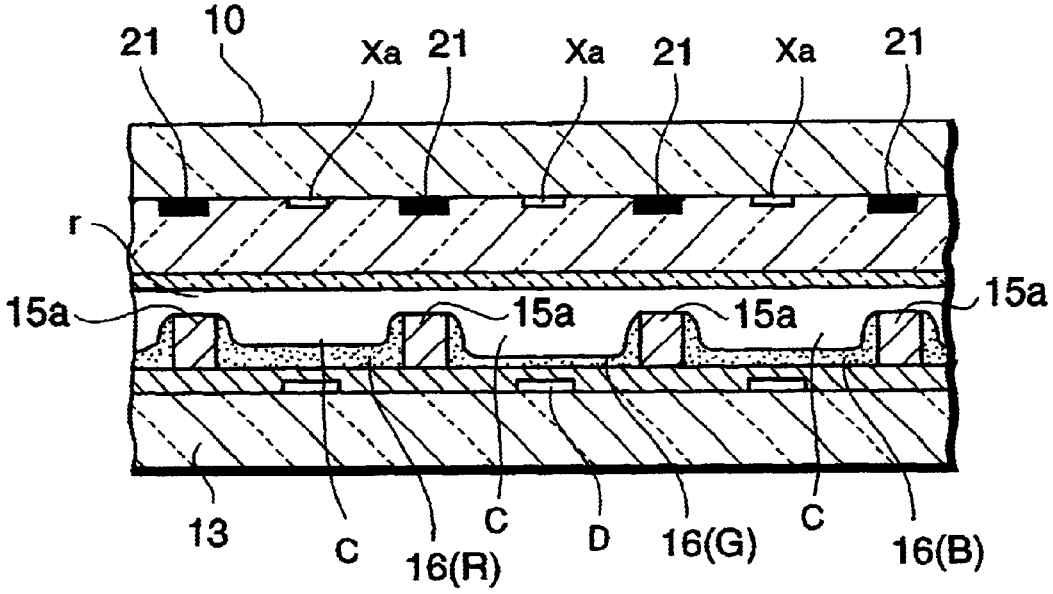
FIG. 4 is a sectional view taken along the W1—W1 line of FIG. 1.
Figure 5:
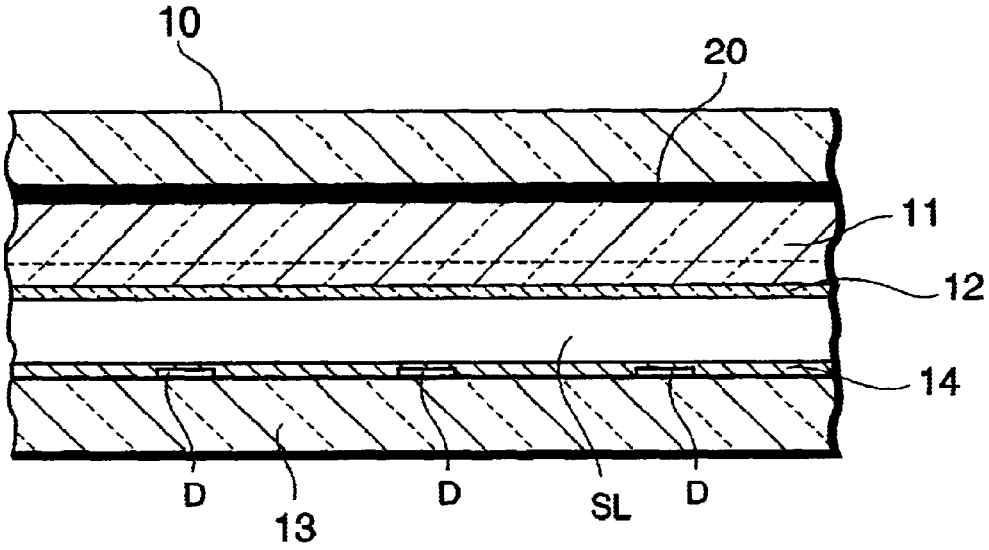
FIG. 5 is a sectional view taken along the W2—W2 line of FIG. 1.

FIG. 1 to FIG. 5 illustrate a first example of the preferred embodiment of a plasma display panel (hereinafter referred to as "PDP") according to the present invention. FIG. 1 is a schematic front view of the PDP of the first example. FIG. 2 is a sectional view taken along the V1—V1 line of FIG. 1. FIG. 3 is a sectional view taken along the V2—V2 line of FIG. 1. FIG. 4 is a sectional view taken along the W1—W1 line of FIG. 1. And, FIG. 5 is a sectional view taken along the W2—W2 line of FIG. 1.

The PDP illustrated in FIGS. 1 to 5 includes a front glass substrate 10 serving as a display surface. A plurality of row electrode pairs (X, Y) are arranged on the back surface of the front glass substrate 10, and each extend in a row direction of the substrate 10 (in the left-right direction of FIG. 1).

Each of the row electrodes X includes transparent electrodes Xa and a bus electrode Xb, in which each of the transparent electrodes Xa is formed of a transparent conductive film made of ITO or the like and constructed in a letter-T shape by a leading member Xa1 having a larger width and a base member Xa2 having a smaller width, and the bus electrode Xb is formed of a wide metal film extending in the row direction of the front glass substrate 10 and connected to the base members Xa2 of the electrode Xa.

Each of the row electrodes Y includes transparent electrodes Ya and a bus electrode Yb, in which each of the transparent electrodes Ya is formed of a transparent conductive film made of ITO or the like and is constructed in a letter-T shape by a leading member Ya1 having a larger width and a base member Ya2 having a smaller width, and the bus electrode Yb is formed of a wide metal film extending in the row direction of the front glass substrate 10 and connected to the base members Ya2 of the electrode Ya.

The row electrodes X and Y are alternated in position in a column direction (the vertical direction in FIG. 1) of the front glass substrate 10. In each row electrode pair, each of the transparent electrodes Xa placed along the bus electrodes Xb extends toward the bus electrode Yb and each of the transparent electrodes Ya placed along the bus electrode Yb extends toward the bus electrode Xb, so that the tops of the leading members Xa1 and Ya1 of the respective transparent electrodes Xa and Ya are opposite to each other with a discharge gap g, having a predetermined width, between.

Each of the bus electrodes Xb and Yb has a double-layer structure formed of a black conductive layer Xb', Yb' on the display surface side, and a main conductive layer Xb", Yb" on the rear surface side.

On the back surface of the front glass substrate 10, a black light absorption layer (light shield layer) 20 extends along the bus electrodes Xb, Yb in the row direction between the back-to-back bus electrodes Xb, Yb of the respective row electrode pairs (X, Y) adjacent to each other in the column direction. Additionally, a light absorption layer (light shield layer) 21 is formed in a position opposite a vertical wall 15*a*, which is stated later, of a partition wall 15 (see FIGS. 3 and 4).

A dielectric layer 11 is also formed on the back surface of the front glass substrate 10 so as to cover the row electrode pairs (X, Y). On the back surface of the dielectric layer 11, an additional dielectric layer 11A protrudes from the back surface of the dielectric layer 11 in a position opposite to the back-to-back bus electrodes Xb, Yb of adjacent row electrode pairs (X, Y) and opposite to a region between the back-to-back bus electrodes Xb, Yb, and extends in parallel to the bus electrodes Xb, Yb.

A protective layer 12 made of MgO is formed on the back surfaces of the dielectric layer 11 and additional dielectric layers 11A.

The front glass substrate 10 is situated in parallel to a back glass substrate 13 having a surface facing toward the display surface on which column electrodes D are arranged parallel to each other at predetermined intervals and each extend in a band-like shape in a direction at right angles to the row electrode pair (X, Y) (the column direction) in a position opposite to the paired transparent electrodes Xa and Ya in each of the row electrode pairs (X, Y).

As illustrated in FIG. 1, the column electrode D has a width d1 slightly larger than a width of each of the base members Xa2, Ya2 of the transparent electrodes Xa, Ya of the row electrodes X, Y in the row direction, and a width d2 of which both sides jut in the row direction in a position opposite to the leading member Ya1 of the transparent electrode Ya of the row electrode Y so that the width d2 is slightly larger than a width of the leading member Ya1 of the transparent electrode Ya. The width d2 forms a enlargement member Da opposite to the entire surface of the leading member Ya1 of the transparent electrode Ya.

On the surface of the back glass substrate 13 on the display surface side, a white dielectric layer 14 covers the column electrodes D, and the partition walls 15 are formed on the dielectric layer 14.

Figure 6:
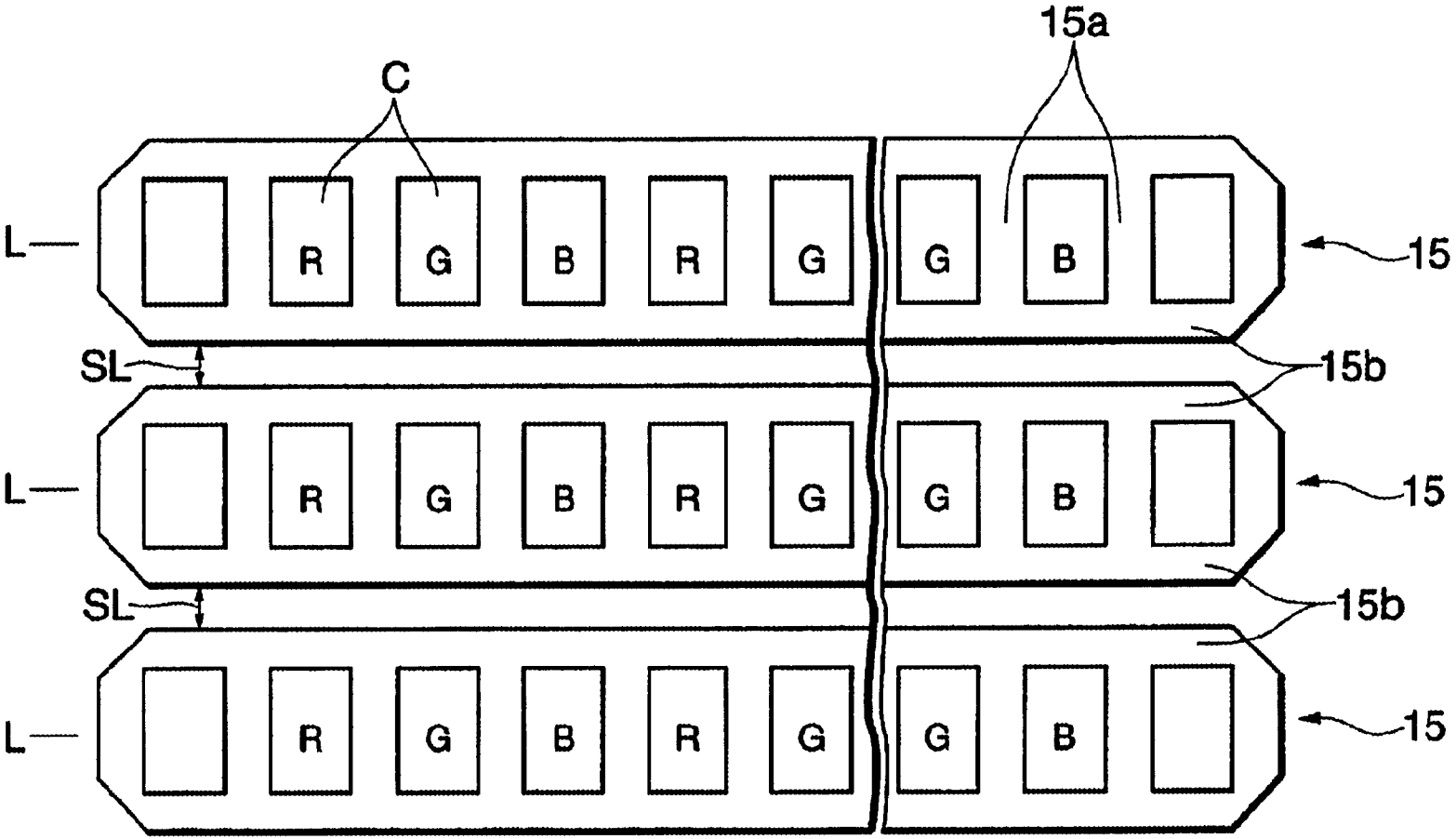
FIG. 6 is a front view illustrating a structure of a partition wall in the example.

As illustrated in FIG. 6, the partition wall 15 is shaped in a ladder pattern with vertical walls 15*a* each of which extends in the column direction in a position between two adjacent column electrodes D arranged in parallel, and transverse walls 15*b* each of which extends in the row direction in a position opposite to the additional dielectric layer 11A.

The partition walls 15 are arranged in the column direction such that the two transverse walls 15*b* extend in parallel to the row direction with an interstice SL, extending in the row direction in a position opposite to the light absorption layer 20 situated between the two display line, interposed between the two walls 15*b*.

Each of the ladder-shaped partition walls 15 partitions the discharge space S, interposed between the front glass substrate 10 and the back glass substrate 13, into areas each opposite to the transparent electrodes Xa and Ya paired in each row electrode pair (X, Y), to define respective quadrangular discharge cells C.

The face of the vertical wall 15*a* of the partition wall 15 on the display surface side is out of contact with the protective layer 12 (see FIG. 4) so that a clearance r is interposed between them. The face of the transverse wall 15*b* on the display surface side is in contact with part of the protective layer 12 covering the additional dielectric layer 11A (see FIGS. 2 and 5) to shield a discharge cell C from another discharge cell C adjacent thereto in the column direction.

The phosphor layer 16 covers all the five faces of each discharge cell C made up of one face of the dielectric layer 14 and the four side faces of the vertical walls 15*a* and transverse walls 15*b* of the partition wall 15 which face toward the discharge cell C.

The three primary colors red, green and blue applied to the phosphor layers 16 are arranged in order a red color (R), a green color (G) and a blue color (B) in the row direction for each discharge cell C (see FIG. 4).

When a selective discharge is produced between the row electrode Y and the column electrode D as described later, the red phosphor layer 16(R) facilitates the discharge but the green phosphor layer 16(G) is resistant to cause the discharge. Due to the fact, it is designed that relative to a thickness of the blue phosphor layer 16(B), the red phosphor layer 16(R) has a larger thickness, and the green phosphor layer 16(G) has a smaller thickness as shown in FIG. 4.

The discharge space S (discharge cells C) is filled with a discharge gas.

In the above PDP, each of the row electrode pairs (X, Y) forms a display line L on a matrix display screen.

Such a PDP generates images through the following procedure.

In an addressing period after completion of a reset period, an operation pulse is applied to the row electrode Y and a data pulse is applied to the column electrode D, whereupon a selective discharge is caused between the row electrode Y and the column electrode D in each discharge cell C at intersection of the row electrode Y applied with the operation pulse and the column electrode D applied with the data pulse. Resulting from the selective discharge, lighted cells (the discharge cell C in which the wall charge is formed on the dielectric layer 11 by the selective discharge) and non-lighted cells (the discharge cell C in which the wall charge is not formed on the dielectric layer 11 by the selective discharge) are distributed in all display lines over the panel surface in accordance with an image to be displayed.

In the addressing period, due to the enlargement member Da formed in the column electrode D, an opposite area of the larger width leading member Ya1 of the transparent electrode Ya and the column electrode D is increased significantly more than an opposite area of other portions of the transparent electrode Ya and column electrode D. With the increased opposite area, the discharge between the row electrode Y and the column electrode D is caused concentratedly in the opposite part of the larger width leading member Ya1 of the transparent electrode Ya and the enlargement member Da of the column electrode D.

Thus, it is prevented that discharge property instability which results from the fact that the selective discharge caused between the row electrode Y and the column electrode D disadvantageously extends toward the base member Ya2 of the transparent electrode Y. In addition, because the expanding of the discharge toward the base member Ya2 of the transparent electrode Y is effectively suppressed, it is possible to eliminate adverse effect exerted on the discharge by overlapping part of the base member Ya2 of the transparent electrode Y and the transverse wall 15*b* of the partition wall 15, resulting in more stable discharge properties.

The selective discharge produced between the row electrode Y and the column electrode D is dependent on kinds of phosphor materials used for forming the phosphor layer in each discharge cell C. The red phosphor layer facilitates the discharge and the green phosphor layer is resistant to cause the discharge. However, in the PDP of the example, the red phosphor layer 16(R) has a thickness larger than that of the blue phosphor layer 16(B), and the green phosphor layer 16(G) has a thickness smaller than that of the blue phosphor layer 16(B). Accordingly, a range of voltage for causing the selective discharge in each color discharge cell C is averaged, thereby producing uniform selective discharge, resulting in enhancement of a selection margin.

After completion of the addressing period, a discharge sustaining pulse is simultaneously applied alternately to the row electrode pairs (X, Y) in all the display lines L. In each application of the discharge sustaining pulse, a surface discharge is caused in each lighted cell. The surface discharge generates ultraviolet light to excites the phosphor layer 16(R), 16(G), 16(B) in each lighted cell to emit light of the three primary colors red (R), green (G) and blue (B) for forming images on the display surface of the PDP.

Figure 7:
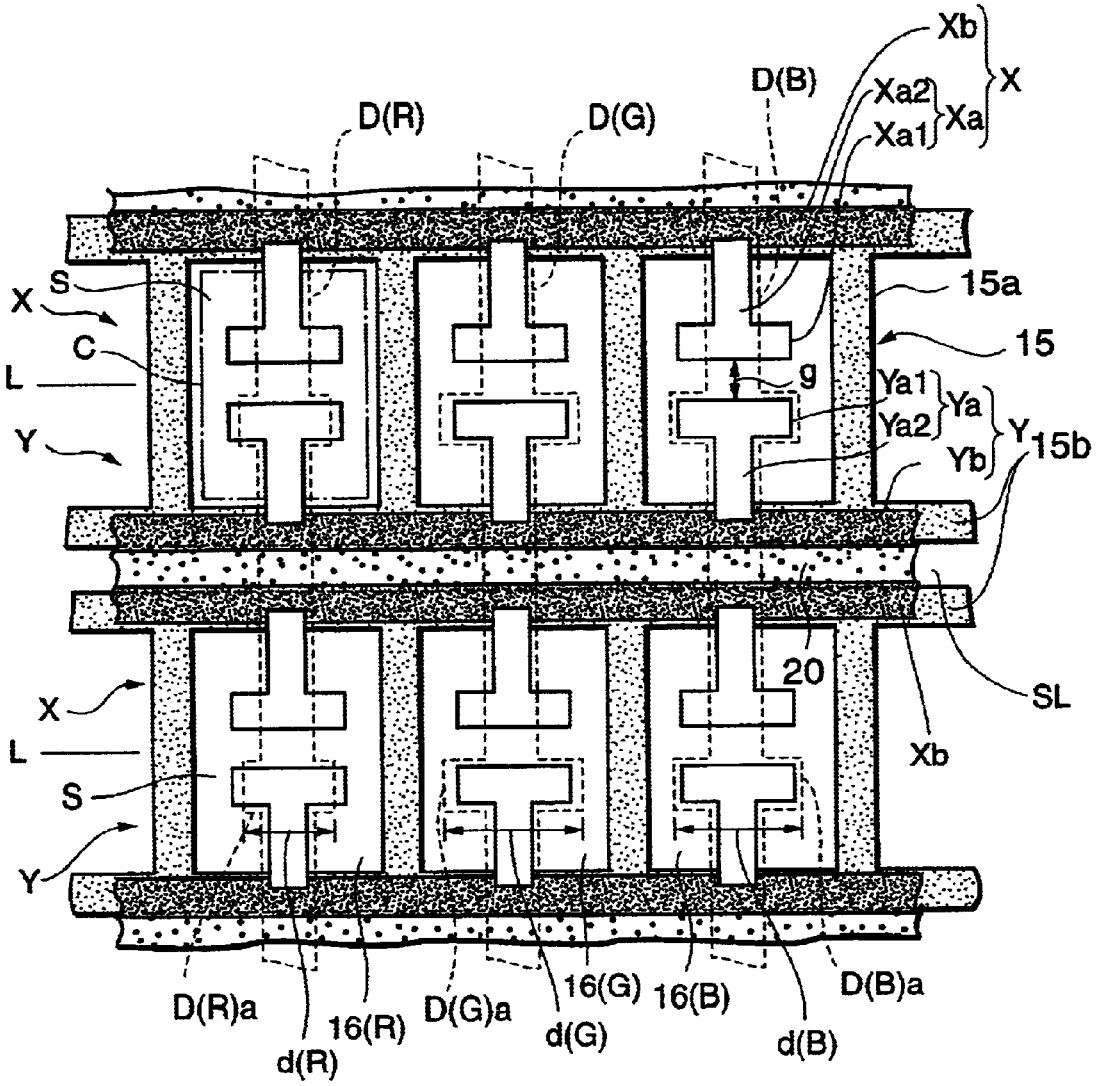
FIG. 7 is a schematic front view of a second example according to an embodiment of the present invention.

FIG. 7 is a schematic front view of a second example of a PDP according to the embodiment of the present invention.

In FIG. 7, the red phosphor layer 16(R), green phosphor layer 16(G) and blue phosphor layer 16(B) are formed inside the discharge cells C in order from the left to right in the row direction.

A column electrode D(R) is allocated to the discharge cell C with the phosphor layer 16(R) formed therein. A column electrode D(G) is allocated to the discharge cell C with the phosphor layer 16(G) formed therein. A column electrode D (B) allocated to the discharge cell C with the phosphor layer 16(B) formed therein.

As in the case of the aforementioned first example, the column electrodes D(R), D(G), D(B) respectively include enlargement members D(R)a, D(G)a, D(B)a at positions opposite to the corresponding leading members Ya1 of the transparent electrodes Ya of the row electrodes Y. The enlargement members D(R)a, D(G)a, D(B) a are formed so as to have the respective width d(R), d(G) d(B) in the row direction in a relation of d(R)<d(B)<d(G).

Other configuration of the PDP in the second example is the same as that of the PDP in the first example.

The PDP in the second example has a relation of d(R)<d (B)<d(G)for the width d(R), d(G), d(B) of the respective enlargement members D(R)a, D(G)a, D(B)a of the column electrodes D(R), D(G), D(B). Specifically, the discharge cell C with the red phosphor layer 16(R) facilitating the discharge is provided with the smallest opposite area of the enlargement member D(R)a of the column electrode D(R) and the leading member Ya1 of the transparent electrode Ya. The discharge cell C with the green phosphor layer 16(G) resistant to cause the discharge is provided with the largest opposite area of the enlargement member D(G)a of the column electrode D(G) and the leading member Ya1 of the transparent electrode Ya. With this design, it is suppressed that the discharge properties is varied due to different kinds of the phosphor materials used in each discharge cell C, which allows producing of uniform selective discharge.

In the second example illustrated in FIG. 7, the enlargement member D(R)a is formed in the column electrode D(R) which is provided for the discharge cell C with the red phosphor layer 16(R) facilitating the discharge. However, for the aim of reducing an opposite area of the leading member Ya1 of the transparent electrode Ya and the column electrode D(R) to a minimum, the enlargement member may not be provided in the column electrode D(R).

The PDP in the second example is designed such that the enlargement members D(R)a, D(G)a, D(B)a of the column electrodes D(R), D(G), D(B) have the respectively widths in accordance with the discharge properties of the phosphor materials used for the phosphor layer formed in each discharge cell C. Hence, it is possible to cause uniform selective discharge in the discharge cell C for each color only by appropriately determining a width of each of the enlargement members D(R)a, D(G)a, D(B)a, in which case the phosphor layers 16(R), 16(G), 16(B) are formed so as to have an equal thickness.

Figure 8:
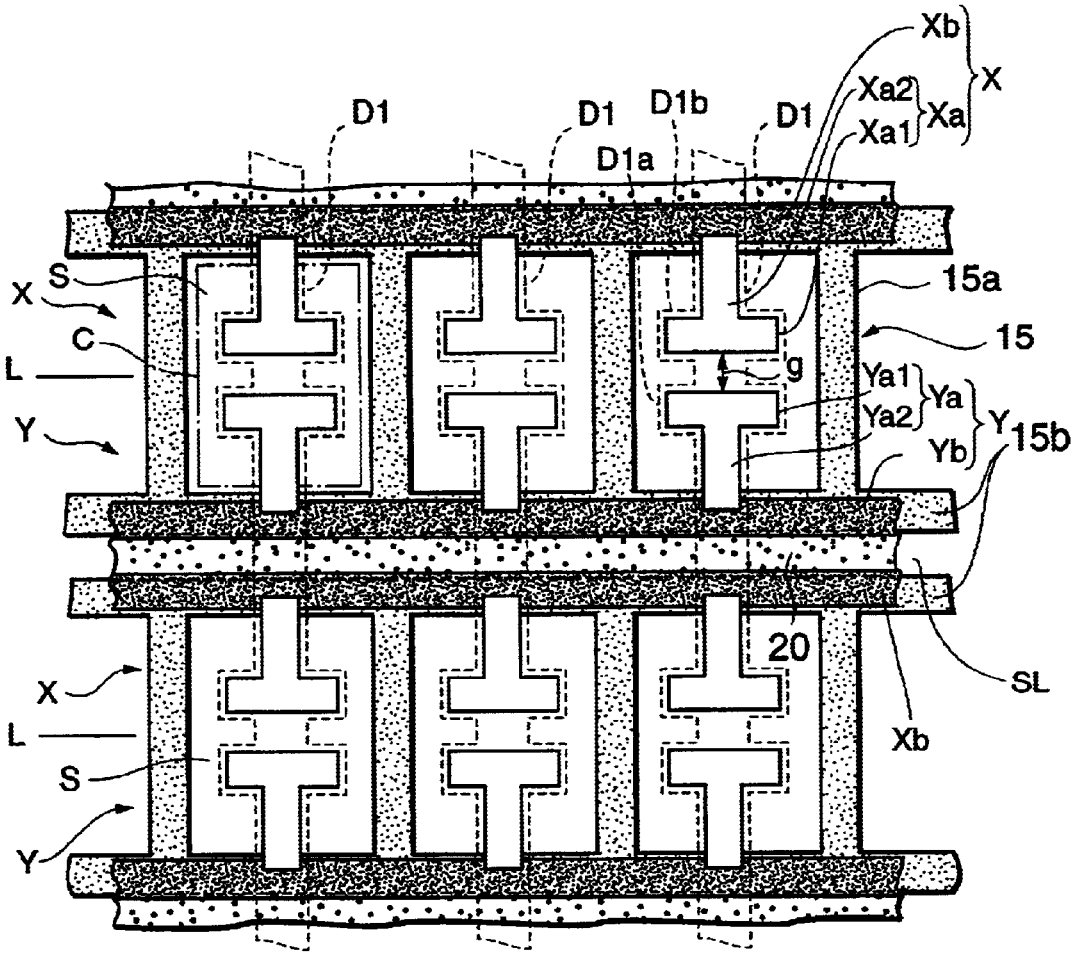
FIG. 8 is a schematic front view of a third example according to an embodiment of the present invention.

FIG. 8 is a schematic front view of a third example of a PDP according to the embodiment of the present invention.

In FIG. 8, each of column electrodes D1 is provided with a first enlargement member D1*a* opposite to the leading member Ya1 of the transparent electrode Ya of the row electrode Y as in the case of the enlargement member Da of the column electrode D in the first example, and further a second enlargement member D1*b* opposite to the leading member Xa1 of the transparent electrode Xa of the row electrode X.

Other configuration of the PDP in the third example is the same as that of the PDP in the aforementioned first example.

As in the case of the PDP in the first example, the PDP in the third example is allowed, due to the first enlargement member D1*a* formed in the column electrode D1, to concentratedly cause the selective discharge between the leading member Ya1 of the transparent electrode Ya and the first enlargement member D1*a* of the column electrode D1 in the addressing period. For this reason, the expansion of the selective discharge toward the base member Ya2 of the transparent electrode Ya is suppressed, resulting in prevention of the discharge properties from becoming unstable.

In the PDP of the third example, in the case of a selective erase scheme for the lighted cells (in which wall charge is formed in all the discharge cells C through the reset discharge and then the walls charge is selectively erased through the selective discharge), discharge is continuously caused between the row electrode X and the row electrode Y after the selective discharge has been caused between the column electrode D1 and the row electrode Y. In this point, the PDP facilitates the discharge between the row electrode X and the row electrode Y because of the second enlargement member D1*b* formed in the column electrode D1 at the position opposite to the leading member Xa1 of the transparent electrode Xa.

Figure 9:
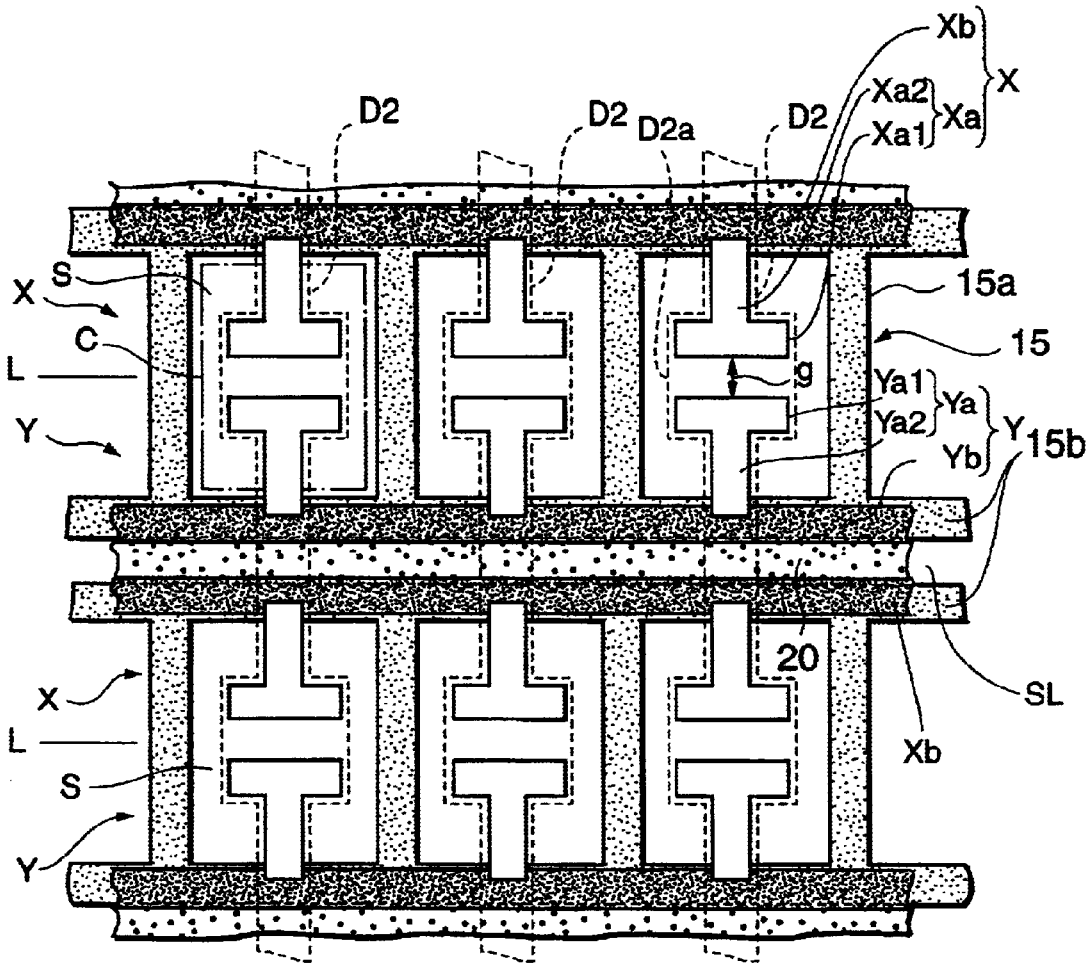
FIG. 9 is a schematic front view of a fourth example according to an embodiment of the present invention.
Figure 10:
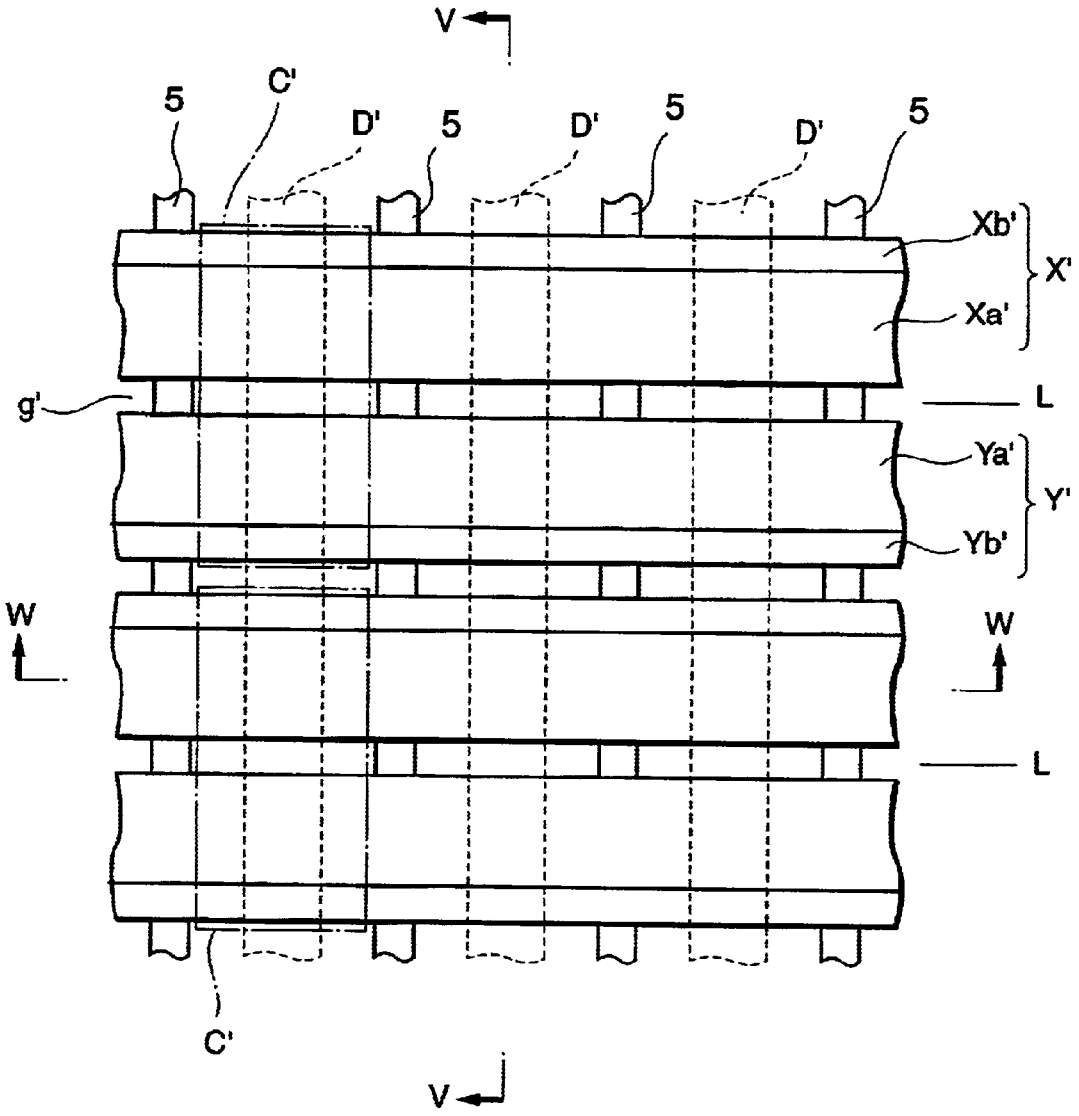
FIG.10 PRIOR ART
FIG. 10 is a schematic front view of a construction of a conventional PDP.
Figure 11:
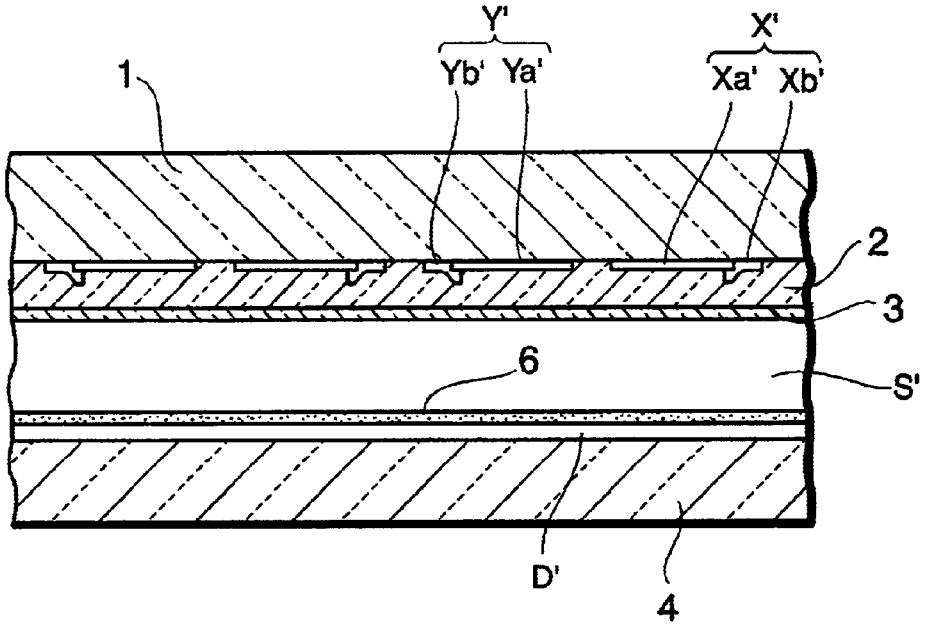
FIG. 11 is a sectional view taken along the V—V line of FIG. 10.
Figure 12:
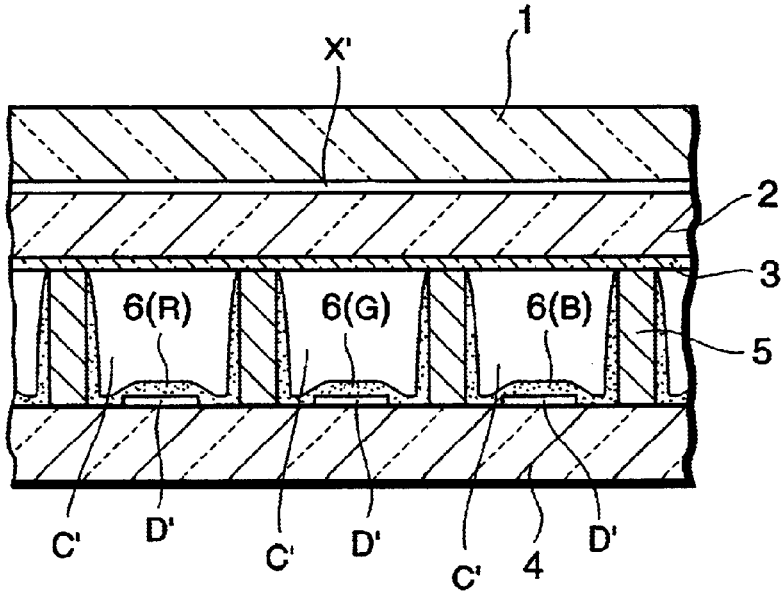
FIG. 12 is a sectional view taken along the W—W line of FIG. 10.

FIG. 9 is a schematic front view of a fourth example of the PDP according to the embodiment of the present invention.

In the aforementioned third example, the column electrode D1 is shaped by separating the first enlargement member D1*a* from the second enlargement member D1*b* which are respectively opposite to the leading members Ya1, Xa1 of the transparent electrodes Xa, Ya, whereas in the fourth example, the PDP includes a column electrode D2 having a single enlargement member D2*a* opposite to both the leading members Xa1, Ya1 of the transparent electrodes Xa, Ya in each discharge cell C.

As in the case of the PDP in the third example, the PDP in the fourth example is allowed, due to the enlargement member D2*a* formed in the column electrode D2, to concentratedly cause the selective discharge between the leading member Ya1 of the transparent electrode Ya and the enlargement member D2*a* of the column electrode D2 in the addressing period. For this reason, the expansion of the selective discharge toward the base member Ya2 of the transparent electrode Ya is suppressed, resulting in prevention of the discharge properties from becoming unstable. In addition, in the case of employing the selective erase scheme, it is easy to cause the discharge between the row electrodes X and Y after the selective discharge has been caused between the column electrode D2 and the row electrode Y because the leading member Xa1 of the transparent electrode Xa is opposite to the enlargement member D2*a* of the column electrode D2.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel including:

a front substrate;

a back substrate placed opposite to the front substrate to define a discharge space between the front and back substrates;

a plurality of row electrode pairs extending in a row direction and arranged in a column direction on a back surface of the front substrate to respectively form display lines; and a plurality of column electrodes arranged in the row direction on a surface, facing toward the front substrate, of the back substrate, and extending in the column direction to intersect the row electrode pairs and form unit light emitting areas in the discharge space at the respective intersections, said plasma display panel comprising:

a leading member provided in each paired row electrodes of said row electrode pairs and facing each other with a discharge gap there-between in each unit light emitting area; and an enlargement member provided in said column electrode at a position opposite to at least one of said leading members of the paired row electrodes in each unit light emitting area, and having a width in the row direction larger than a width of portion of said column electrode opposite to the row electrode except for the leading member opposite to the enlargement member.

2. A plasma display panel according to claim 1, further comprising a phosphor layer for emitting a different color in each unit light emitting area, wherein said enlargement member of said column electrode is changed in width in the row direction to be smaller in order of the colors facilitating discharge between said row electrode and said column electrode.

3. A plasma display panel according to claim 2, wherein said enlargement member of said column electrode has, in the row direction, a small width of a side facing toward the unit light emitting area provided with said red phosphor layer, and a larger width of a side facing toward unit light emitting area provided with said blue phosphor layer, and a much larger width of a side facing the unit light emitting area provided with said green phosphor layer.

4. A plasma display panel according to claim 1, wherein said enlargement members are provided in pair in said column electrode at respective positions opposite to said leading members of the paired row electrodes in each unit light emitting area, and having a width in the row direction larger than a width of portion of the column electrode opposite to the row electrode except for the leading member opposite to the enlargement member.

5. A plasma display panel according to claim 1, wherein said enlargement member is provided in said column electrode at a position opposite to both of said leading members of the paired row electrodes in each unit light emitting area, and having a width in the row direction larger than a width of portion of the column electrode opposite to the row electrode except for the leading members opposite to the enlargement member.

6. A plasma display panel according to claim 1, further comprising phosphor layers for emitting different colors, each provided in each unit light emitting area and having a larger thickness as the phosphor layer more facilitates discharge between said row electrode and said column electrode.

7. A plasma display panel according to claim 6, wherein said phosphor layer is reduced in thickness in order of the unit light emitting area provided with said red phosphor layer, the unit light emitting area provided with said blue phosphor layer, and the unit light emitting area provided with said green phosphor layer.

8. A plasma display panel according to claim 1, wherein the row electrodes of each of said row electrode pairs respectively include main bodies extending in the row direction, and jutting sections extending from the respective main bodies in the column direction to face each other with the discharge gap there-between in each of the unit light emitting areas, and respectively having base members connected to the respective main bodies, and said leading members facing each other and each having a width larger than that of the base member, wherein said enlargement member of the column electrode is opposite to said leading member having the larger width of said jutting section of one of said paired row electrodes.

9. A plasma display panel according to claim 1, further comprising a partition wall between said front substrate and said back substrate, having vertical walls each extending in the column direction and transverse walls each extending in the row direction, and provided for partitioning the discharge space, defined between the front and back substrates, in the row and column directions to define the unit light emitting areas.

* * * * *